US007810266B2

(12) United States Patent
Arnthorsson

(10) Patent No.: US 7,810,266 B2
(45) Date of Patent: Oct. 12, 2010

(54) GRAPHIC DISPLAY PANEL

(76) Inventor: Kristjan Freyr Arnthorsson, Suite 501 International House, 223 Regent Street, London (GB) W1B 2QD ( * ) Notice: Subject to any disclaimer, the term of this patent is extended or adjusted under 35 U.S.C. 154(b) by 511 days.

(21) Appl. No.: 11/631,665

(22) PCT Filed: Jul. 7, 2005

(86) PCT No.: PCT/IB2005/001935

§ 371 (c)(1),
(2), (4) Date: Feb. 13, 2008

(87) PCT Pub. No.: WO2006/006056

PCT Pub. Date: Jan. 19, 2006

(65) Prior Publication Data

US 2008/0250563 A1 Oct. 16, 2008

(30) Foreign Application Priority Data

Jul. 8, 2004 (GB) ..... 0415380.5

(51) Int. Cl.
*G09F 19/00* (2006.01)

(52) U.S. Cl. ..... 40/615; 40/541

(58) Field of Classification Search ..... 40/615, 40/443, 546

See application file for complete search history.

(56) References Cited

U.S. PATENT DOCUMENTS 1,658,301 A * 2/1928 Power ..... 428/39
1,781,313 A * 11/1930 Blau ..... 428/201
5,414,947 A * 5/1995 Hjaltason ..... 40/615
5,682,697 A * 11/1997 Hjaltason ..... 40/615
5,992,068 A * 11/1999 de Saro ..... 40/564
6,240,664 B1 * 6/2001 Hjaltason ..... 40/546
6,526,681 B1 3/2003 De Saro

FOREIGN PATENT DOCUMENTS

EP 0607261 A 7/1994
EP 1058277 A 12/2000

* cited by examiner

*Primary Examiner*—Lesley Morris
*Assistant Examiner*—Kristina Staley
(74) *Attorney, Agent, or Firm*—Charles D. Gunter, Jr.; Stephen S. Mosher

(57) ABSTRACT

A graphic design consists of graphic elements such as text, logos, images and texture. On the front surface of transparent substrate, a white translucent copy in the form of chosen graphic elements in the design (such as text) is applied, so when viewed from front is right-reading. The complete original graphic design is then applied in register onto the front surface, so that the parts of the design that were copied onto the front surface first come directly onto contact with that copy. A white copy in the form of the other areas (the graphic elements that were not copied onto the front) is applied onto the back of the substrate (i.e. the side facing away from the viewer) in register with the rest of the design (in reverse, so when viewed from front is right-reading). Further copies of this one may be applied behind it (i.e. on the back) to increase its opacity. A light-source is placed behind the substrate.

15 Claims, 3 Drawing Sheets

GRAPHIC DISPLAY PANEL

TECHNICAL FIELD

This invention relates to a graphic panel for an illuminated display.

Conventional graphic panels that are backlit (internally illuminated displays) have existed for a long time. They are in essence a graphic design that is applied onto light transmitting substrate. The application is by the means of printing (such as screen-printing, painting etc), with light-transmitting colour substances such as inks or vinyl foils. The application is usually onto one side of the substrate and the result is a flat, two-dimensional graphic. A light-source is placed behind the finished graphic panel and illuminates the graphic design.

A graphic design is constructed of its graphic elements (such as text, logos, pictures, etc) which all have their boundaries within the graphic design. We refer to certain graphic elements (such as text, logos etc) to be Foreground Graphic Elements and the others (usually the surrounding background colour, texture etc) to be Background Graphic Elements. (What graphic elements are Foreground—and what are Background Elements is ultimately a chose based on the viewer's individual perception or opinion)

In recent years, new methods for producing graphic panels for backlit displays have been developed which use several layers of application of colour materials such as inks (printed or otherwise) and use both sides of a transparent substrate. Using such methods gives control over the way in which light passes through and interacts with the substrate and the layers of ink used in the build-up of the graphic design. The purpose of these methods is to attain certain visually stimulating lighting effects and control over the intensity of light in chosen areas of the graphic design.

We refer to these methods as Multi-Layer Print Processes (MLPP) for Backlit Graphic Display Panels.

BACKGROUND ART

Other multi-layer print processes exist and some have been patented such as the process under U.S. Pat. Nos. 5,414,947; 5,682,697; European Patent No 0607261 B.

In that process, the Foreground Graphic Elements are physically separated from their surrounding Background Graphic Elements. The Background Graphic Elements are applied on the back of the clear substrate along with some extra layers of ink or films behind these. A white Reflection copy in the shape of the Foreground Graphic Elements is applied onto the front surface of the substrate in register with the back so that its shape covers the hollow areas of the Background Graphic Elements. The Foreground Graphic Elements are applied onto the front of the said white Reflection layer in register with the back. The light from the light-source then passes through the openings of the back layers (i.e. the shapes left open by the absence of the text or logos that now reside on the front of the substrate). When the light passes through these openings and through the clear substrate, it hits a white Reflection layer on the front of the substrate (which is in the shape of the text or logos) and is reflected back onto the surrounding Background Graphic Layer. The opening on the back is made larger then the graphic element on the front, i.e. its hollow shape is bolder. A fundamental aspect of this invention is that the Background Graphic Elements are applied onto the back surface of the clear substrate and the Foreground Graphic Elements are applied onto the front surface of the said substrate.

The above method produces visual lighting effects that change the viewer's perception of the graphic design, giving perceived relief effect to the Foreground Graphic Elements (e.g. the text or logos) and can also give an aura around the said graphic elements.

But the method has certain limitations, as some colour-combinations are not possible without drastically changing their perception. For example, when attempting to achieve coloured aura around a white Foreground Graphic Element (such as text or logo), the Foreground Graphic Element will appear colour-polluted once backlit—the light transmitted through it will already have transmitted through the underlying colour and thus be coloured light.

The most common manufacturing process for producing displays using the above and similar methods (i.e. the application of colour layers onto substrate) is screen-printing and adhesive film (sign-foil) application. The method mentioned above requires high level of opacity in the inks used in printing in order to produce the required effects. However, in the screen-printing industry, recent developments in ink manufacture have resulted to a shift from solvent-based inks to a new type—UV inks. These inks are more environmentally friendly but are more transparent than solvent-based.

DISCLOSURE OF INVENTION

The present invention provides an alternative method for producing visual lighting effects comparable to those achieved using the above mentioned method. However, the present invention allows for colour combinations that are not achievable using the previous method. Moreover, while generally requiring less number of layers the present invention is also more suited to the use of UV-inks.

In the present invention, a copy of the so-called Foreground Graphic Elements is applied onto the front surface of the substrate. This copy is usually—but not limited to—white, and acts as a Front Reflection Layer. In a similar way, a copy of the so-called Background Graphic Elements is applied directly in register onto the back surface of the substrate. This layer is also usually, but not limited to, white and acts as a Back Reflection Layer. More copies of this layer may be added directly behind this layer on the back in order to increase its opacity. Using transparent (or translucent) colour materials such as inks, the whole graphic design is applied onto the front of the substrate, where the Foreground Graphic Elements in the design come in contact with their copy—the Front Reflection Layer and in register. The rest of the graphic design, i.e. the Background Graphic Elements come in direct contact with the front surface of the said substrate.

The application of layers (of ink) is usually by method of printing (such as screen printing, litho-printing, digital or other), either straight onto the substrate, or onto films that are then applied (e.g. by means of lamination) onto the substrate. Alternatively, by means of applying adhesive colour films (sign foils) in place of printing.

A specific embodiment of the invention will now be described by way of example with reference to the accompanying drawings in which:

BEST MODE FOR CARRYING OUT THE INVENTION

Figure 1:
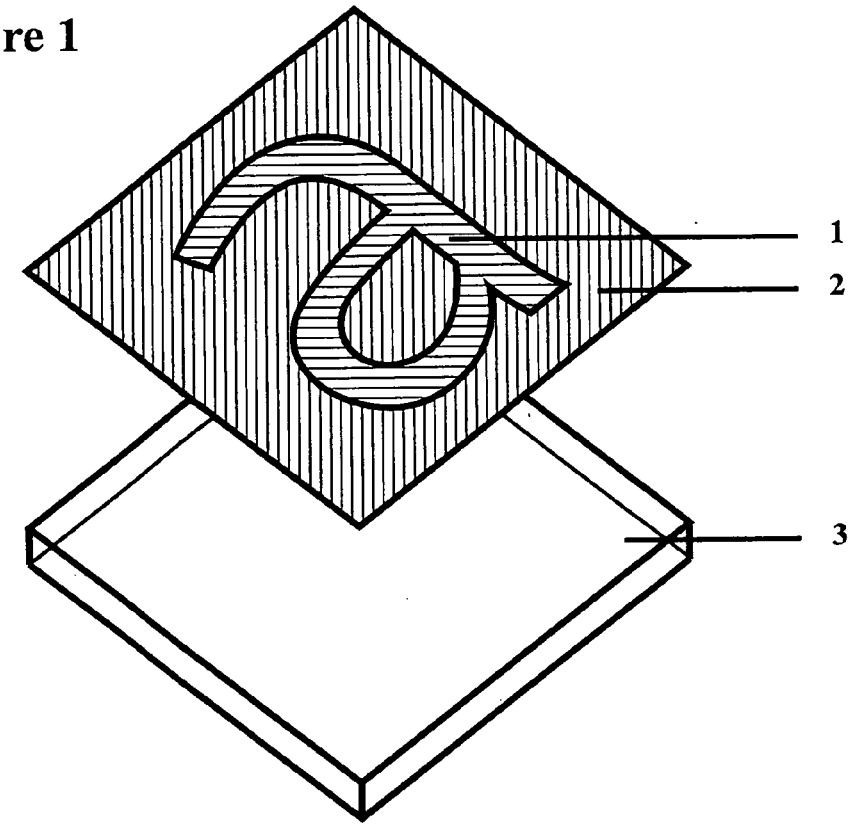
FIG. 1 shows a graphic design (consisting of Foreground and Background Graphic Elements) and a substrate: Foreground Graphic Element (1); Background Graphic Element (2); Substrate (3).

Referring to FIG. 1 in this example, the graphic subject matter is made of a yellow letter 'a' (the Foreground Graphic Element (1)) out of a blue background (the Background Graphic Element (2)).

Figure 2:
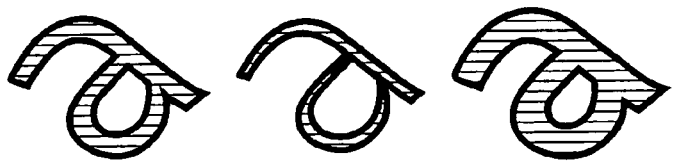
FIG. 2 illustrates an element before (left image), after with an inline resulting in a thinner body (middle image), and with an outline resulting in a bolder body (right image).
Figure 3:
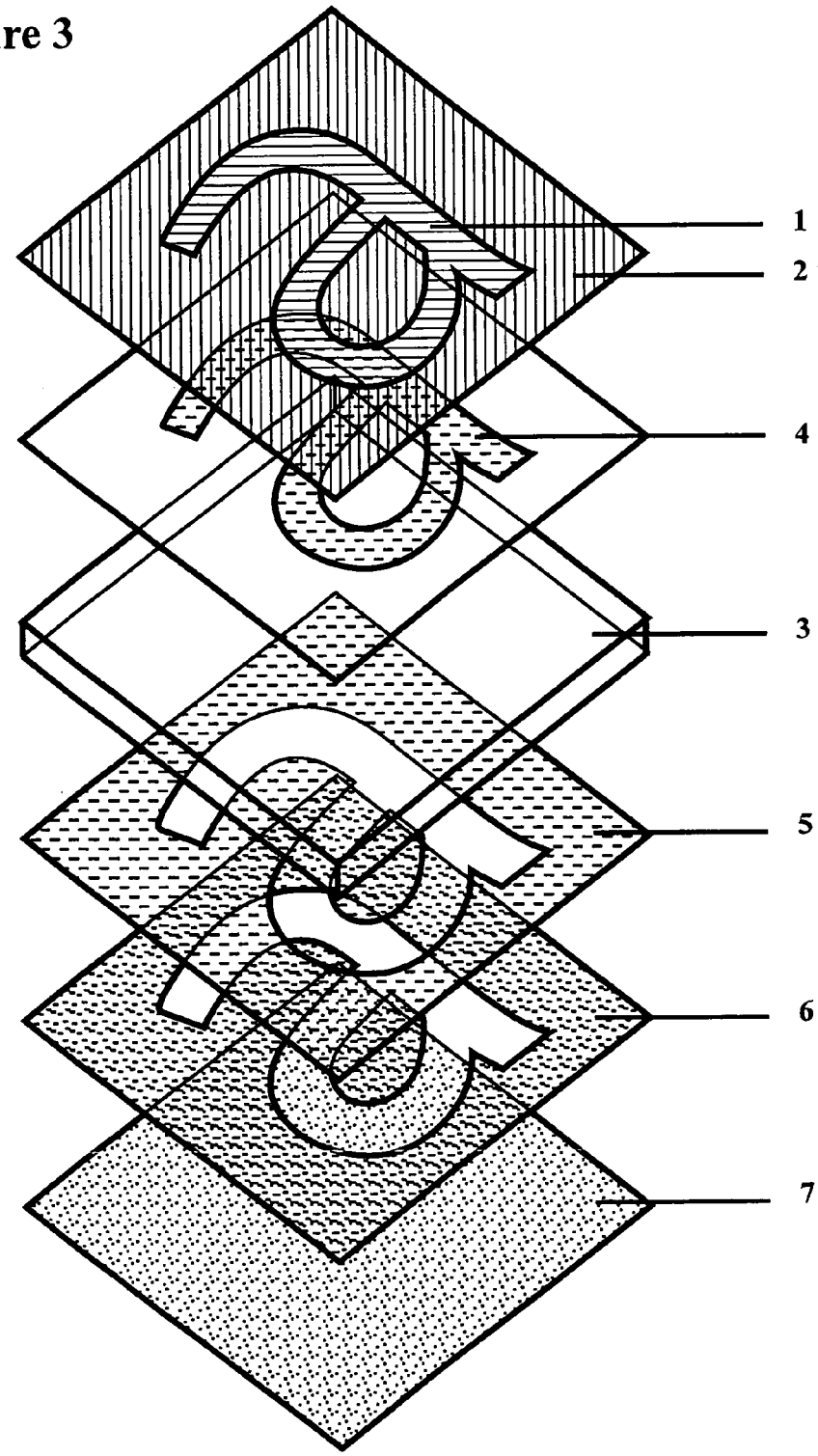
FIG. 3 shows the graphic design with its corresponding copies in an exploded diagram: The Front Reflection Layer (4); Back Reflection Layer (5); Back Opacity Layer (6); Diffusion Layer (7).
Figure 4:
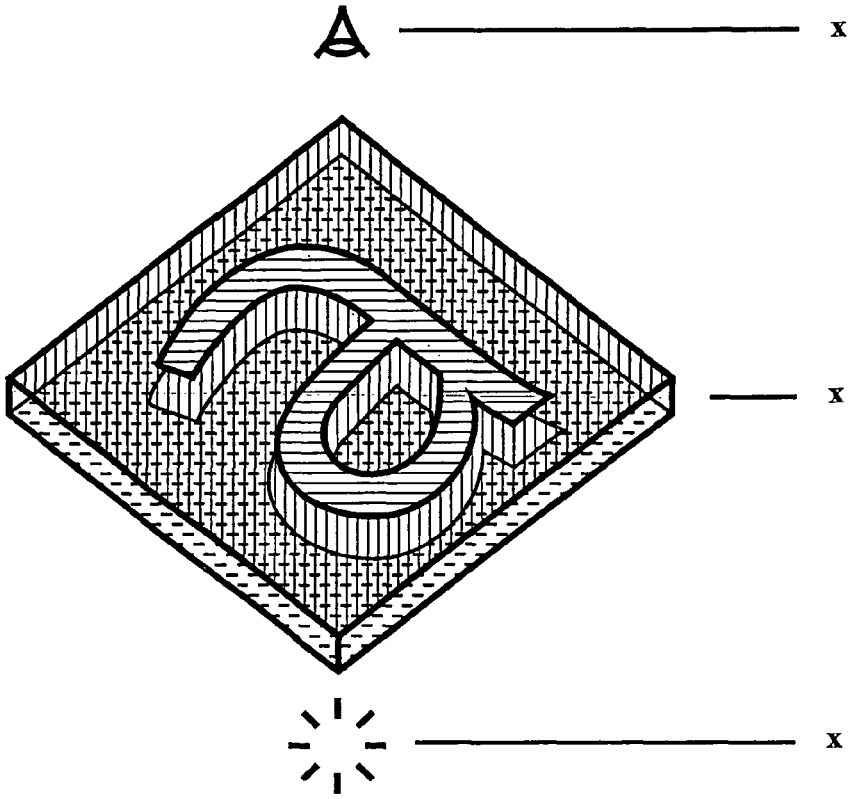
FIG. 4 shows the finished (after application) graphic panel. In this example, the opening on the background was made larger and the relief effect (mainly a result of the substrate thickness) can be appreciated.
Figure 5:
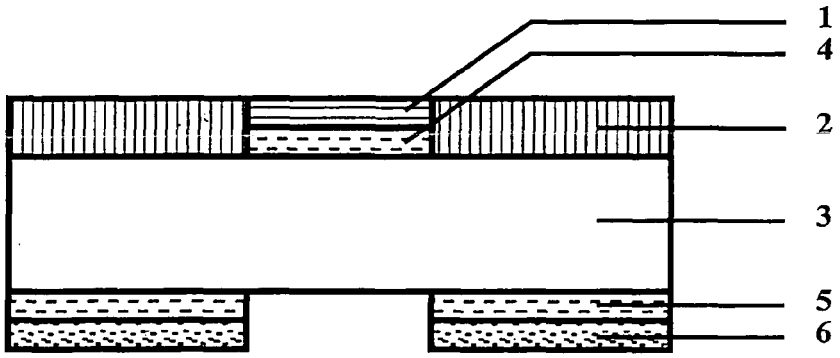
FIG. 5 shows the graphic design of FIG. 3 in cross section but without the optional diffusion layer (7).

A copy in the shape of the Background Graphic Element (2) is made. Because this is a copy of only the Background Graphic Element it contains hollow areas where the Foreground Graphic Element used to be. This copy is made white (white is preferred, but can be any bright reflective colour). This is the Back Reflection Layer (5). The aperture of the hollow opening (i.e. the area left hollow by the absence of the Foreground Graphic Elements) is increased slightly—i.e. an outline is created around it and the boundaries of the hollow areas in the copy are decided by this outline—See FIGS. 2 & 3. This layer is applied onto the back surface in reverse (so when viewed from front is right-reading)—See FIG. 3.

A new copy is made in the shape of the above Back Reflection Layer. The purpose of this copy is to increase the opacity of the Back Reflection Layer—the level of opacity affects the strength of the final halo effect and often a low level of this effect may be the preferred option. The opacity in this layer therefore allows control over this effect. If the opacity of the Back Reflection Layer is sufficient this Back Opacity Layer is not required.

Finally for the back, an optional diffusion layer is added. This is a translucent, milky-white layer and covers the said openings in the above two layers. The purpose of this is to act as a light diffuser so as to prevent the viewer seeing straight through the said openings and into the light-source. This layer is not needed if a separate sheet of diffusion is used behind the graphic panel or if the light-source is such that diffusion is not required.

A copy in the form of the Foreground Graphic Element is made. The colour of this copy is made white and is applied onto the front surface directly in register with the corresponding 'negative' already applied onto the back surface.

Using transparent (or translucent) colour materials such as inks, the whole graphic design is now applied onto the front of the substrate, where the Foreground Graphic Element in the design comes in contact with its copy—the Front Reflection Layer and in register. The rest of the graphic design, i.e. the Background Graphic Element comes in direct contact with the front surface of the said substrate.

Once the graphic panel is constructed in the said manner, a light-source is placed behind the said panel.

The light traveling from the light-source hits the back of the graphic panel:

1. The light that hits the areas covered by the Back Reflection and/or Back Opacity Layer is partly absorbed and partly reflected back. Only a part may get through (dependant on the level of opacity in the said Back layers) and is filtered through these layers, through the substrate and finally through the Foreground Graphic Elements—until it reaches the viewer. By this time the light has been so filtered that its strength is diminished and it has attained colours of the said filtering layers.
2. The light that hits the areas not covered by the Back Reflection Layer and/or Back Opacity Layer passes through the substrate and hits the Front Reflection Layer on the front and are diffuse-reflected back on to the surrounding Back Reflection Layer on the back of the substrate and there again diffuse-reflected, this time forth (towards the viewer) and through the Background Graphic Layer which is on the front of the substrate. This layer being either transparent or translucent acts as a colour filter, and the light that now reaches the viewer is not white, but of the colour of the background graphic. This results in increased light appearing around the Foreground Graphic Elements—an aura or halo. In this example blue.
3. As in 2 above, but the light that does not hit the Front Reflection Layer, i.e. travels past its sides, goes straight through the Background Graphic Element. This area being either transparent or translucent acts as a colour filter, and the light that now reaches the viewer is not white, but of the colour of the background graphic. In this example brightly lit blue.
4. As in 2 above, but the light that is not reflected but is partly absorbed, partly travels through both the Front Reflection Layer and the Foreground Graphic Element, and so its colour is affected by the colour of this layer/element and in this example changes from white to yellow.

Transparent ink exposes the sharp contrast in the shape of the opening in the back and thus the letter 'a' seems to be a built-up letter (to have a base—the opening, and a top—the Foreground Graphic Element). Relief effect is achieved.

What is claimed is:

1. A method of providing a graphic display panel comprising the steps of:

providing a transparent substrate panel having a given thickness;

providing a whole graphic design divided into zones made of graphic elements, said whole graphic design formed of foreground graphic elements and background graphic elements;

forming a front reflective layer of a white or bright reflective color on a front surface of the substrate panel with a first duplicate portion of one or more foreground graphic elements of the whole graphic design such that the appearance of the first duplicate portion is right-reading when viewed from the front surface of the substrate panel;

applying the whole graphic design including all foreground and background elements onto the front surface of the substrate panel such that the portions of the whole graphic design that were duplicated for the front reflective layer are placed into direct contact with the front reflective layer and second unduplicated portions of the whole graphic design are placed into direct contact with the front surface of the substrate panel; and forming a back reflective layer of a white or bright reflective color on a reverse surface of the substrate panel with the second unduplicated portions of the whole graphic design such that said second unduplicated portions formed on the reverse surface of the substrate panel are right-reading when viewed from the front surface of the substrate panel.

2. The method of claim 1, further comprising the step of:

applying one or more times a third duplicate of the back reflection layer on said reverse surface of the substrate panel directly behind and in register with the back reflection layer, thereby forming a back opacity layer, substantially blocking light transmission there through.

3. The method of claim 2, further comprising the step of:

applying at least one first diffusion layer to said reverse surface of the substrate panel to cover the combined back reflective layer and back opacity layer.

4. The method of claim 2, further comprising the step of:

applying a second diffusion layer to said front surface of said substrate panel to cover at least a portion thereof.

5. The method of claim 2, further comprising the step of:

increasing the area of the hollow areas in the back reflection layer corresponding in shape to the foreground graphic elements of the back reflection layer or the back opacity layer to a wider aperture than is defined by an outline given to those shapes prior to applying them to said substrate panel.

6. The method of claim 2, further comprising the step of:

decreasing the area, in the back reflection layer and the back opacity layer, of the open areas left blank by the absence of the foreground graphic elements to a narrower aperture defined by an inline given to those shapes prior to applying them to said substrate panel.

7. The method of claim 2, further comprising the step of:

increasing the width of a body of the front reflective layer and/or the foreground graphic elements to provide a wider body defined by an outline given to those shapes prior to applying them to said substrate panel.

8. The method of claim 2, further comprising the step of:

decreasing the width of a body of the front reflective layer and/or the foreground graphic elements to provide a narrower body defined by an inline given to those shapes prior to applying them to said substrate panel.

9. The method of claim 1, wherein said substrate panel is translucent.

10. The method of claim 1, wherein said substrate panel is colored.

11. The method of claim 1, further comprising the step of:

forming said substrate of separate first and second substrate panels and an intervening gap having a dimension.

12. The method of claim 11, further providing the step of:

shifting the registration of the layers between the front and reverse surfaces of the substrate panel from 100 percent registration to being off-registration by an amount up to or equal to twice the dimension of the gap between the front and reverse surfaces of the substrate panel.

13. The method of claim 1, further comprising the step of:

applying the respective front and back reflective layers onto separate transparent or translucent sheets; and applying the separate sheets onto respective front and reverse surfaces of the substrate panel.

14. The method of claim 13, wherein the step of applying the separate sheets comprises the step of:

laminating the sheets onto the substrate panel.

15. The method of claim 1, further comprising the step of:

directing illumination of the graphic panel toward said reverse surface of the graphic panel from a light source disposed behind said graphic panel.

* * * * *